US007146125B2

(12) United States Patent
Stelter et al.

(10) Patent No.: US 7,146,125 B2
(45) Date of Patent: Dec. 5, 2006

(54) TRANSFER ROLLER WITH RESISTIVITY RANGE

(75) Inventors: Eric C. Stelter, Pittsford, NY (US); Joseph E. Guth, Holley, NY (US); Paul S. Gloyer, Nashville, TN (US); George R. Walgrove, III, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 207 days.

(21) Appl. No.: 10/678,287

(22) Filed: Oct. 3, 2003

(65) Prior Publication Data

US 2004/0126156 A1 Jul. 1, 2004

Related U.S. Application Data

(60) Provisional application No. 60/416,362, filed on Oct. 4, 2002.

(51) Int. Cl.
*G03G 15/20* (2006.01)

(52) U.S. Cl. ..... 399/313; 492/48; 492/53

(58) Field of Classification Search ..... 399/121, 399/297, 310, 313, 314; 361/214; 492/48, 492/53

See application file for complete search history.

(56) References Cited

U.S. PATENT DOCUMENTS

| | | | | |
|---|---|---|---|---|
| 5,101,238 | A | 3/1992 | Creveling et al. | |
| 5,132,738 | A * | 7/1992 | Nakamura et al. | 399/101 |
| 5,745,820 | A * | 4/1998 | Iwakura et al. | 399/45 |
| 5,909,611 | A * | 6/1999 | Iwakura | 399/302 |
| 5,915,150 | A * | 6/1999 | Kukimoto et al. | 399/149 |
| 5,923,937 | A * | 7/1999 | Thompson et al. | 399/302 |
| 6,081,686 | A * | 6/2000 | Abe et al. | 399/303 |
| 6,097,913 | A | 8/2000 | Ichihara | |
| 6,097,923 | A * | 8/2000 | Iwakura et al. | 399/313 |

* cited by examiner

*Primary Examiner*—Hoan Tran
(74) *Attorney, Agent, or Firm*—Donna P. Suchy

(57) ABSTRACT

An electrographic machine has a transfer station where a toner image is transferred to a receiver sheet. That sheet travels at a high speed of more than 15 inches per second and up to as high as 35 inches per second. A transfer roller has a metal core and an elastomeric sleeve with a resistivity selected to optimize transfer of toner at high speeds. The resistivity of the sleeve is selected to be high enough to support transfer of the toner but not so high as to cause the surface voltage to exceed the breakdown voltage of the dielectric material that includes the elastomeric sleeve, the receiver sheet, the toner and the photoconductor.

18 Claims, 2 Drawing Sheets

TRANSFER ROLLER WITH RESISTIVITY RANGE

BACKGROUND

High speed electrographic engines preferably use roller transfer to move a toner image from a charge retentive dielectric member, such as a photoconductor, to the receiver, which is usually paper or transparency material. Corona wire devices are also used for transferring toner, but the performance of corona transfer is inferior to that of roller transfer, particularly at high speeds. The transfer roller is a conductive, elastomeric roller that is biased to a polarity opposite the toner polarity. During transfer, the front surface of the receiver is brought adjacent the toner image carried by the photoconductor, the roller contacts the back surface of the receiver, and the image is transferred to the front surface of the receiver by the electric field produced by the transfer roller. The area of contact of the transfer roller and the receiver is described as the transfer nip.

An adjustable constant current supply is preferably used to produce a constant charge density on the receiver. This results in a constant electric field for transfer independent of the receiver thickness. Toner with higher charge requires a higher charge density on the receiver and greater transfer current. The electric current setpoint of the constant current supply is adjusted appropriately for high charge toner or low charge toner. Faster process speeds also require proportionally higher current to produce the same surface charge density. At high output currents, the current supply operates at high voltages.

During transfer, as a point on the roller rotates toward the paper, charges must be conducted to the outer surface of the roller. If the roller resistivity is too large or the time interval for approach and passage through to the nip is too short, a high voltage is required for the constant current supply to apply the necessary charge density to the receiver, resulting in a high voltage on the roller surface and producing ionization defects on the image. This is particularly a problem for high toner charge to mass ratios greater than −30 μC/g and at high process speeds greater than 17.5 ips (110 PPM).

Prior art indicates that a minimum surface charge density is required for uniform transfer of toner. High speed processes provide less time for this charge to be applied and for toner transfer. Prior art suggests that increasing the transfer current for high speed processes to apply the appropriate surface charge density will result in uniform toner transfer. However, we found that increasing the current with the prior art transfer roller did not solve the problem for high speed processes without introducing transfer defects, and another solution had to be found.

SUMMARY OF THE INVENTION

The invention provides a new roller with defined resistivities as a function of the operating speed of the machine and of the transfer current. The invention is also a method of operating an electrographic machine by selecting the resistivity of its transfer roller as a function of the speed of the process, the required transfer current, and the dimensions of the transfer roller. In one embodiment the transfer roller has a resistivity ranging from $1.0\times10^9\pm0.5\times10^9$ Ω-cm to $0.65\times10^9\pm0.32\times10^9$ Ω-cm for a receiver travel speed of between 15–20 inches per second to 40 30–35 inches per second. The corresponding currents are approximately 45 μA at 15–20 inches per second to approximately 85μA at 30–35 inches per second. The method of the invention is used to operate an electrographic reproduction machine at a high speed. The method transfers toner from a toned image carrying member to a receiver sheet. The transfer roller receives a current that provides charge to the roller for transferring the toner from the toned image carrying member (photoconductor) to the receiver sheet. The roller is fashioned from any suitable material. The resistivity of the roller is adjusted to fall in a range of values dependent upon the operating speed of the machine. For speeds in the range of about 15–20 inches per second, the resistivity is chosen to be about $1.0\times10^9\pm0.5\times10^9$ Ω-cm with a current of approximately 45 μA. For higher speeds in the range of 30–3540 inches per second, the resistivity is lowered to about $0.65\times10^9\pm0.32\times10^9$ Ω-cm and the current is increased to approximately 85 μA. The values of resistivity and of current can be scaled to other speeds and roller dimensions by those experienced in the art.

DETAILED DESCRIPTION OF THE DRAWINGS

DETAILED DESCRIPTION OF THE INVENTION

Figure 4:
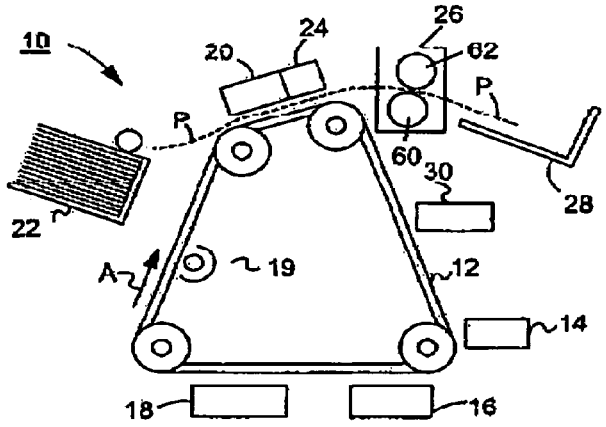
FIG. 4 is a schematic representation of an electrographic machine.

Referring now to the accompanying drawings, FIG. 4 schematically illustrates a typical reproduction apparatus 10, of the electrophotographic type, suitable for utilizing an exemplary roller transfer assembly such as shown and described in U.S. Pat. Nos. 6,097,913, and 5,101,238 whose entire disclosures are incorporated by reference. The reproduction apparatus 10, described herein only to the extent necessary for a complete understanding of this invention, includes a photoconductor (charge member) retentive photoconductor 12 that carries the toned, developed image. The photoconductor 12 is, for example, in the form of an elongated endless web mounted on support rollers and movable about a closed loop path through a series of electrographic process stations in the direction of the arrow A.

In the reproduction cycle for the reproduction apparatus 10, the moving phototconductor 12 is uniformly charged as it moves past a charging station 14. Thereafter the uniformly charged photoconductor 12 passes through an exposure station 16 where the uniform charge is altered to form a latent image charge pattern corresponding to information desired to be reproduced. Depending upon the characteristics of the photoconductor 12 and the overall reproduction system, formation of the latent image charge pattern may be accomplished by exposing the photoconductor 12 to a reflected light image of an original document to be reproduced or "writing" on the photoconductor 12 with a series of lamps (e.g., LED's or lasers) or point electrodes activated by electronically generated signals based on the desired information to be reproduced. The latent image charge pattern on the photoconductor 12 is then brought into association with a development station 18 which applies pigmented marking (toner) particles to adhere to the photoconductor 12 to develop that latent image. After development, the image is erased by a lamp 19 adjacent the back side of the photoconductor, which minimizes the difference in voltage between areas of the photoconductor coated with toner particles and areas that are not coated with toner particles. Here the back side of the photoconductor is the side that is not developed with particles. After erasure, the photoconductor 12 is at a low voltage, such as 0V to 50 V. Other means of producing a nearly uniform voltage on the photoconductor 12 can be used, such as controlled light exposure to the front side of the photoconductor 12, or corona charging the toner-bearing and non-toner bearing portions of the front side of the photoconductor 12. In this case, the voltage is approximately uniform and non-zero. The portion of the photoconductor 12 carrying the developed image then passes by a supply hopper 22 along the path P. A receiver sheet 8 is withdraw from a hopper 22 and is registered with the developed image. An electric field produced in the transfer station 20 attracts the marking particle of the developed image from the photoconductor 12 to the receiver member.

The electric transfer field may also cause the receiver member 8 to adhere to the photoconductor 12. Accordingly, a detack mechanism 24, immediately downstream in the direction of travel of the photoconductor, is provided to facilitate removal of the receiver member from the photoconductor. The detack mechanism may be, for example, an AC corona charger for neutralizing the attractive field holding the receiver member to the photoconductor. After the developed image is transferred to the receiver member 8 and the receiver member 8 is separated from the photoconductor, the receiver member is transported through a fusing device 26 where the image is fixed to the receiver member 8 by heat and/or pressure for example, and delivered to an output hopper 28 for operator retrieval. Simultaneously, the photoconductor 12 is cleaned of any residual marking particles at cleaning station 30 and returned to the charging station 14 for reuse.

The fusing station 26 includes fuser roller 60 and support roller 62. The receiver sheet 8 passes between fusing roller 60 and support roller 62. The toner material carried by the receiver sheet is then permanently fixed to the surface of the receiver sheet 8 by the temperature and pressure provided by fuser roller 60 and support roller 62.

Figure 1:
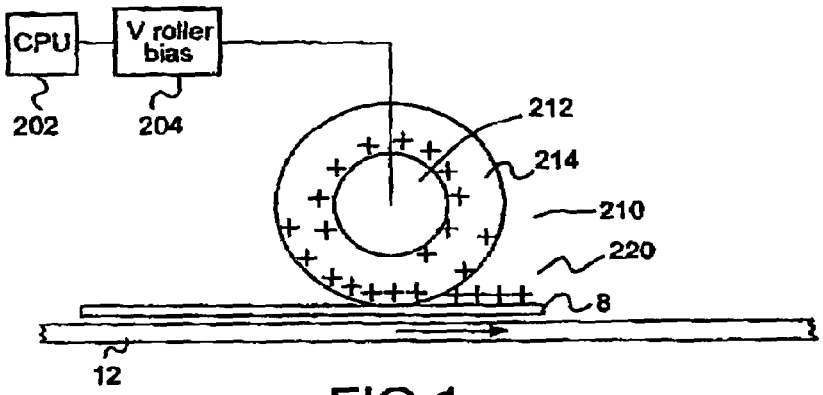
FIG. 1 is a schematic view of a transfer station.

This invention comprises an improvement in the transfer station, and, in particular, an improvement in the transfer roller. The new transfer roller has preferred resistivity ranges as a function of process speed and of the dimensions of the transfer roller so that the required charge is applied to the receiver, bias voltages are low, and pre-nip ionization and post-nip ionization are minimized. The transfer roller is shown in FIG. 1. Transfer roller 210 at transfer station 20 is shown connected to a voltage limited constant current source 204. The level of voltage and current is controlled by a central processing unit CPU 202. The roller 210 has an inner roller 212 of steel or other highly conductive material. The outer roller 214 is a polyether-polyurethane composition. With the transfer roller 210 in operative association with the photoconductor 12 (i.e., nip relation), ionization current is divided between the pre-nip and post-nip regions. Charge can also be injected in the nip region if the surface of the transfer roller is rough. Under normal operating conditions, virtually all of the ionization occurs in the post-nip region 220 for effective transfer of the marking particle developed image from the photoconductor 12 to the receiver member 8. A small amount of pre-nip ionization can be tolerated but must be regulated to prevent image transfer defects. For the preferred resistivity range, most of the transfer current is applied within the nip and at the trail edge of the nip. One side of receiver sheet 8 contacts the transfer roller 210. The other side of the receiver sheet 8 contacts the toned image on the photocondutor 12. The charge on the back of the receiver sheet attracts the toner from photoconductor 12 to the receiver sheet 8. The charged receiver sheet retains the toner and the sheet 8 is sent to the fuser where the image is fixed to the sheet 8.

Figure 2:
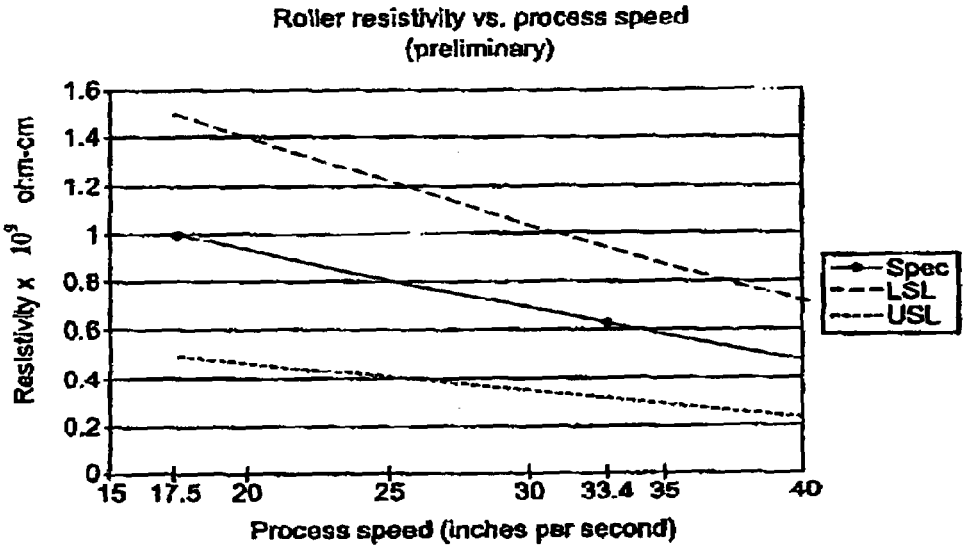
FIG. 2 is a graph of roller resistivity as a function of process speed.

The transfer roller 210 used in the Digisource 9110 has an outside diameter of 1.000" on a conductive shaft of diameter 0.500", resulting in an elastomer thickness of 0.25". The nip width is approximately 0.125". The 1" diameter elastomer section of the roller is 14.5 inches long. At 110 PPM or 17.5 ips, rollers with nominal resistivity on the order of $1.0\times10^9$ ohm-cm are used with current of approximately 45 microamps for toner with charge-to-mass-ratio of approximately −30 μC/g at toner coverage per unit area of approximately 12 g/m$^2$ For a transfer roller approximately 14.5 inches in length, a surface charge density of approximately $2.75\times10^{-4}$C/m$^2$ is applied to the receiver. Experiments showed that adjusting transfer current proportionally with speed, acceptable results were obtained with a nominal roller at 150 PPM (pages per minute) with current at approximately 60 microamps using toner with charge of approximately −30 μC/g. However, at 210 PPM or 33.4 ips, with transfer current increased proportionally to approximately 80 microamps, increased mottle was observed in solid areas of high density. As such, increasing the current does not solve the problem of toner transfer at high speed. However, we found that at the speed of 210 PPM, a roller with resistivity of $0.62\times10^9$ ohm-cm resulted in good results (low mottle) at currents of 60 to 80 μA. FIG. 2 shows a preliminary plot of recommended roller resistivity vs. process speed. Supply voltages and current for the two rollers are shown in Table 1 and FIG. 3. Calculated surface voltages at the nip for the rollers are shown in Table 2.

TABLE 1

Supply Voltage vs. Current at 210 PPM

| Current (microamps) | Voltage for resistivity of $1.0\times10^9$ Ω-cm | Voltage for resistivity of $0.62\times10^9$ Ω-cm |
|---|---|---|
| 40 | 800 | 510 |
| 60 | 1120 | 720 |
| 80 | 1440 (calculated) | 1100 (actual)<br>930 (calculated) |

Higher speeds require proportionally lower resistivities because the time of approach is smaller. The time of approach is defined as the time interval for a point on the roller surface to move into contact with the receiver from a distance of approximately twice the thickness of the roller blanket, or for a point on the roller surface to rotate toward the receiver through an arc of 90 degrees, whichever is less. Resistivity is measured on an uncoated 0.25" ASTM D-2240 test slab after 12 days conditioning at 70 degrees F., 50% RH. The resistivity of finished rollers is measured on an equivalent test fixture with an electrode that fits the roller surface. All resistivities plotted in this disclosure were measured on finished rollers.

Figure 3:
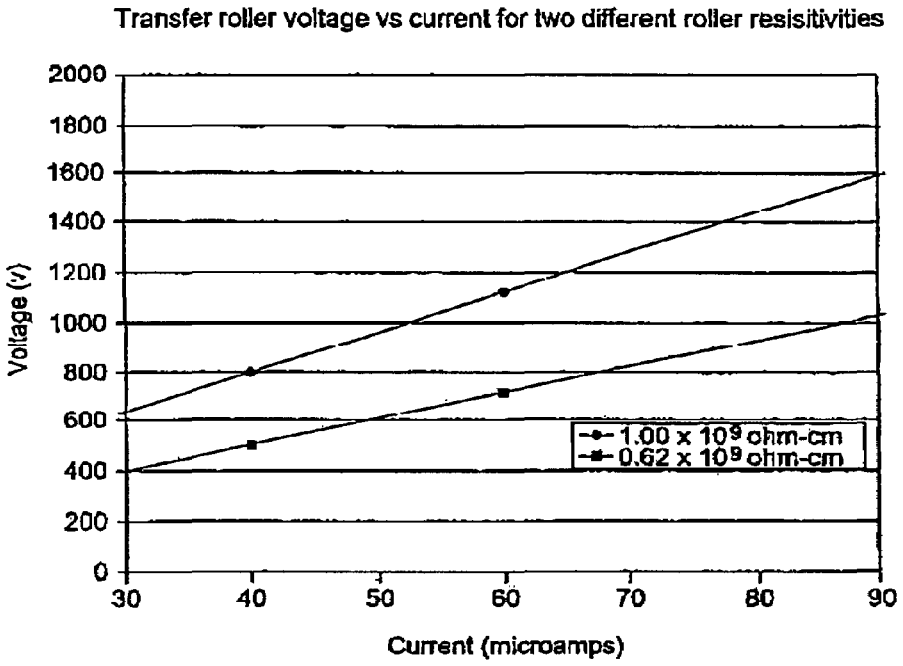
FIG. 3 is a graph of voltage as a function of current output measured at 210 PPM.

Table 1 and FIG. 3 show that, if current is extrapolated to zero, supply voltage is greater than zero. This is believed to be due to contact resistance at the roller surface and the receiver interface. For the roller used in this experimentation, the supply voltage within the applicable current range for transfer can be approximately described by $V=Vc+IR_{Tot}$, where Vc is the voltage extrapolated to zero current, I is the current in amps, and $R_{Tot}$ is the resistance in ohms, calculated from the slope of the data in Table 1 and FIG. 3. The resistance $R_{Tot}$ includes contributions from the roller, receiver, and charge member.

Higher speeds require proportionally larger currents to apply the required surface charge density. For example, scaling the current of 45 microamps used with a 14.5 inch length roller at 17.5 inches per second results in a current in amps at speed v given by $7.0\times10^{-8}$ vL, where v is process speed in ips (inches per second) and L is roller length in cm. Taking into account variation in toner charge to mass ratio and coverage, the required current in amps is approximately given by $1.94\times10^{-10}$ vL×[toner charge to mass ratio (μC/g)×toner area coverage (g/m$^2$)].

If a roller with resistivity suitable for lower speeds is used for operation at higher speeds, the supply voltage must be increased. This can result in high surface voltages on the roller that can produce image defects. Lower roller resistivities are preferred so that lower supply voltages can be used for the appropriate currents, with the result that the potential on the roller surface before entering the transfer nip and after exiting the transfer nip is small enough in magnitude that electric breakdown is minimized. At 760 torr atmospheric pressure, a surface potential less than 350 V, and preferably less than 300 V, is required to minimize breakdown to adjacent surfaces. Depending on the configuration of the reproduction apparatus 10, the surface potential of the roller can be referenced to ground potential, the potential of the surface of the photoconductor, or the potential of the adjacent surface of the receiver. For the case of rear erase with lamp 19, the surface potential of the transfer roller can be referenced to ground. The voltages at which breakdown occurs are well known in the art.

The preferred resistivity is of course dependent on roller dimensions. The transfer roller 210 used in the Digisource 9110 has an outside diameter of 1.000" on a conductive shaft of diameter 0.500", resulting in an elastomer thickness of 0.25". At 17.5 ips process speed, the time of approach is 0.045 sec, and at 33.4 ips, the time of approach is 0.024 sec. Rollers with thicker elastomeric layers require proportionally lower resistivity for the same kind of approach.

The voltage on the roller surface at the nip can be estimated as follows. As the roller rotates, the region of the roller approaching contact with the receiver begins to conduct before that portion of the roller actually contacts the receiver. Between the initiation of conduction in a region of the roller approaching the nip and passage of that region through the nip. For a point on the roller surface, the time of approach is approximately the time for that point to rotate into contact with the receiver and through the nip from a distance of approximately half the roller diameter from the exit side of the nip. This distance is the length of approach. At 17.5 ips process speed with a 1" diameter roller, the time of approach is 0.029 sec, and at 33.4 ips, the time of approach is 0.015 sec. For different geometries, such as transfer belts and wider nips, a similar time of approach and corresponding length of approach can be estimated.

The voltage drop across the transfer roller at the nip is given by $V_{Approach}=IR_{Approach}$, where I is in amps and $R_{Approach}$ is approximately given by [elastomer resistivity (ohm-cm)×elastomer thickness (cm)]/[length of approach (cm)×roller length (cm)]. This equation for $R_{Approach}$ approximates the region in which conductivity occurs as the roller rotates as a rectangular slab with one edge at the nip exit having constant current density. The voltage at the roller surface, $V_{Surface}$ shown in Table 2, is given by supply voltage $V_{Supply}$ minus this voltage drop, and is calculated using values for current and voltage from Table 1 and FIG. 3.

TABLE 2

| Surface Voltage vs. Current | | |
|---|---|---|
| Current (microamps) | Voltage for resistivity of $1.0\times10^9$ Ω-cm | Voltage for resistivity of $0.62\times10^9$ Ω-cm |
| 40 | 257 | 173 |
| 60 | 305 | 215 |
| 80 | 354 | 257 |

Generally, current can be scaled with process speed and width to apply an aim surface charge density. For toner having charge of approximately −30 μC/g and coverage of 12 g/m$^2$ and for the case that the portion of the receiver covered by toner is between 6–12% of the area of an 8.5"×11" sheet, the curve shown in FIG. 1 corresponds to the following empirical relationship:

$$I=7\times10^{-8}vL$$

where current is in amps, v is process speed in ips (inches per second) and L is roller length in cm. Taking into account toner charge and coverage, $$I=2\times10^{-10}vL\times[\text{toner charge-to-mass ratio } (\mu C/g)\times \text{toner area coverage } (g/m^2)]$$

For the aim current, the preferred roller resistivity is given by the solution to the equation $$V_{Surface}\leqq V_{Break}$$

where $V_{Break}$ is referenced to adjacent surfaces.

For systems with a time of approach, $$V_{Supply}-V_{Approach}\leqq V_{Break}$$

If the voltage drop across the roller is ohmic, $$V_{Supply}-IR_{Approach}\leqq V_{Break}$$

If the relationship between supply voltage and current is linear, $$V_C+IR_{Tot}-IR_{Approach}\leqq V_{Break}$$

Approximating $R_{Approach}$ as a rectangular slab of resistivity ρ, $$V_{Supply}-I\rho l/((\text{approach length})\times L)\leqq V_{Break}$$

or $$V_C+IR_{Tot}-I\rho l/((\text{approach length})\times L)\leqq V_{Break}$$

where I is current in amps, ρ is resistivity in ohm-cm, l is blanket thickness in cm, approach length is in cm, L is the length of the elastomer on the roller in cm, voltage is measured in volts, resistance is measured in ohms, and $V_{Break}$ is the approximate breakdown voltage, here taken to be approximately 300 V or 350 V in magnitude. The roller surface at the nip entrance or nip exit should be within 350 V and preferably within 300 V of the receiver surface voltage, or of the photoconductor surface voltage, or of ground. Both $V_C$ and $R_{Tot}$ depend on ρ and receiver parameters. The values of ρ satisfying these equations are best determined by experimentation and iteration. Rollers with thicker elastomeric layers require proportionately lower restivity for the same kind of approach. Longer rollers require greater current. Resistivity should be chosen so that $V_{Surface}$ is large enough to drive current flow to the receiver, but $V_{Surface}$ referenced to adjacent surfaces should not exceed $V_{Break}$. The transfer roller generally operates at high surface voltages near breakdown. If $V_{Supply}$ is greater than $V_{Break}$ and ρ is too low, pre-nip ionization can occur at a level that creates image defects. In this case, the time of approach or the length of approach should be decreased by geometry changes, $R_{Approach}$ should be increased by geometry changes or other means, or ρ should be increased. The resistivity ρ must be within the limits of this disclosure. The foregoing can be applied by those versed in the art to rollers, belts, or other configurations having a time of approach or a length of approach.

A more complete description of the rotating roller/nip geometry includes capacitance and the RC time constant of the roller. Capacitance is strongly dependent on geometry. For rollers of the same overall dimensions, capacitance can be assumed to be constant as resistivity, voltage, or process speeds are changed. Resistivity of the elastomer is measured on an uncoated 0.25" ASTM D-2240 test slab after 12 days conditioning at 70 degrees F., 50% RH. The resistivity of finished rollers is measured on an equivalent test fixture with an electrode that fits the roller surface. All resistivities plotted in this disclosure were measured on finished rollers. Resistivities and currents are generally held to tolerances of +/−50%. The resistivity of $0.62\times10^9$ ohm-cm for a polyether-polyurethane roller formulation (Winfield formulation W734) is obtained by 1.2 weight % of PIP antistat (Eastman Kodak CIN#10056008). For the $1.00\times10^9$ ohm-cm formulation, 0.55 weight % PIP is used. PIP increases the conductivity of the roller and lowers its resistivity. Other conductive materials may also be added or substituted for PIP in order to alter the resistivity of the transfer roller. Greater antistat concentrations and lower resistivities are preferred because they increase roller life. Rollers fail due to increase of resistivity with usage. The foregoing can also be adapted to negative or positive charged toners. This invention can be used with intermediate transfer rollers as well as with transfer rollers. This invention is applicable to technologies using the transfer of powders or layers of powders to surfaces, including electrophotography, ionography, or powder coating, without limitation.

Those skilled in the art also understand that the resistivity is a material characteristic. The overall resistance of the roller depends upon its dimensions including its thickness and length. The formula for resistance is well known as:

$$R=\rho\times\text{-length/cross-sectional area}$$

For transfer rollers, the length corresponds to the thickness of the elastomeric sleeve and the cross-sectional area corresponds to the portion of the surface area of the elastomeric sleeve where current flows between the transfer roller and the photoconductor. Thus, longer rollers will have less resistance than short rollers because they have a larger cross-sectional area for current to travel over and rollers with thin elastomeric sleeves will have less resistance than roller with thicker sleeves because the length of the current path is shorter. For high speed processes, the invention lets the manufacturer select a transfer roller with a chosen resistivity that optimizes toner transfer at the high speed.

What is claimed is:

1. An electrophotographic machine for printing toner-based images comprising:

a charging station for applying an electrostatic charge to a photoconductor;

a discharge station for selectively discharging the photoconductor to create a charged, latent electrostatic image;

a toner station for applying toner particles to the latent electrostatic image to develop a toner image of said electrostatic image; and a transfer station for transferring the toner image to a receiver sheet traveling at a speed of at least 15 inches per second, said transfer station comprising a constant current source, a transfer roller coupled to the constant current source, said transfer roller comprising a metal core and sleeve with a selected resistivity, said selected resistivity being high enough to generate a sufficient transfer voltage but low enough to prevent a breakdown of the dielectric material comprising the transfer roller, receiver sheet, toner, air and the photoreceptor.

2. The machine of claim 1 wherein the resistivity of the transfer roller sleeve is high enough to provide a transfer voltage proximate to but not in excess of the breakdown voltage of the dielectric material comprising the transfer roller, receiver sheet, toner, air and the photoreceptor.

3. The machine of claim 2 wherein the resistivity of the transfer roller sleeve is high enough to generate a transfer voltage of between 300 and 350 volts.

4. The machine of claim 3 wherein the transfer roller has a resistivity ranging from $1.0\times10^9+0.5\times10^9$ Ω-cm to $0.5\times10^9+0.2\times10^9$ Ω-cm.

5. The machine of claim 4 wherein the receiver sheet travels at a speed of between 15 to 40 inches per second.

6. In a machine that moves a receiver sheet between a transfer roller and a photoreceptor at a relatively high speed, a process comprising:

keeping the voltage at the transfer roller high enough to transfer toner and selecting a material for the transfer roller with a resistivity high enough to maintain a voltage between the transfer roller and the photoreceptor proximate to but not in excess of the breakdown voltage of dielectric material comprising the transfer roller, receiver sheet, toner, air and the photoreceptor.

7. The process of claim 6 wherein the relatively high speed is at least 15 inches per second.

8. The process of claim 6 further comprising:

providing a transfer roller;

applying a current to the roller to generated a transfer voltage for transferring a toner image form the photoreceptor to the receiver sheet;

wherein the step of selecting comprises selecting a material for the transfer roller having a resistivity in the range of between from $1.0\times10^9+0.5\times10^9$ Ω-cm to $0.5\times10^9+0.2\times10^9$ Ω-cm.

9. The process of claim 8 further comprising moving the receiver sheet past the transfer roller at a speed between 15 and 40 inches per second.

10. The process of claim 8 wherein the current ranges from 40 to 80 microamps.

11. The process of claim 8 wherein the voltage across the transfer roller ranges from 510 to 1440 volts.

12. The process of claim 8 wherein the voltage across the transfer roller ranges from 800 to 1440 volts for a resistivity of about $1.0\times10^9+0.5\times10^9$ Ω-cm.

13. The process of claim 8 wherein the voltage across the transfer roller ranges from 510 to 1100 volts for a resistivity of about $1.6\times10^9+0.5\times10^9$ Ω-cm.

14. A process for selecting a material for a transfer roller comprising the steps of:

supplying a constant current to a transfer roller having a conductive core and a sleeve on the core with a selected resistivity;

feeding receiver sheets between the transfer roller and a photoreceptor at a relatively high speed;

selecting a material for the transfer roller that is high enough to generate a sufficient transfer voltage but low enough to prevent a breakdown of the dielectric material comprising the transfer roller, receiver sheet, toner, air and the photoreceptor.

15. The process of claim 14 wherein the resistivity of the material for the transfer roller is selected to provide a transfer voltage proximate to but not in excess of the breakdown voltage of the dielectric material comprising the transfer roller, receiver sheet, toner, air and the photoreceptor.

16. A process for selecting a material for a transfer roller comprising the steps of:

supplying a constant current to a transfer roller having a conductive core and a sleeve on the core with a selected resistivity;

feeding receiver sheets between the transfer roller and a photoreceptor at a relatively high speed;

selecting a material for transfer roller with a resistivity that is inversely proportional to the speed of the receiver sheet through the transfer station.

17. The process of claim 16 wherein the resistivity is high enough to generate a sufficient transfer voltage but low enough to prevent a breakdown of the dielectric material comprising the transfer roller, receiver sheet, toner, air and the photoreceptor.

18. The process of claim 17 wherein the resistivity of the transfer roller is selected to provide a transfer voltage proximate to but not in excess of the breakdown voltage of the dielectric material comprising the transfer roller, receiver sheet, toner, air and the photoreceptor.

* * * * *

UNITED STATES PATENT AND TRADEMARK OFFICE

CERTIFICATE OF CORRECTION

PATENT NO. : 7,146,125 B2
APPLICATION NO. : 10/678287
DATED : December 5, 2006
INVENTOR(S) : Eric C. Stelter et al.

It is certified that error appears in the above-identified patent and that said Letters Patent is hereby corrected as shown below:

Column 8, Line 10, after “toner” insert --particles--

Column 8, Line 10, delete “photoreceptor” and insert --photoconductor--

Column 8, Line 15, after “toner” insert --particles--

Column 8, Line 15, delete “photoreceptor” and insert --photoconductor--

Column 8, Line 20, delete “$10^{Y}$” and insert --$10^{9}$--

Column 8, Line 21, delete “$10^{Y}$” and insert --$10^{9}$--

Column 8, Line 23, delete “40” and insert --35--

Column 8, Line 25, delete “photoreceptor” and insert --photoconductor--

Column 8, Line 28, after “toner” insert --particles--

Column 8, Line 31, delete “photoreceptor” and insert --photoconductor--

Column 8, Line 33, after “toner” insert --particles--

Column 8, Line 34, delete “photoreceptor” and insert --photoconductor--

Column 8, Lines 40-41, delete “photo-receptor” and insert --photoconductor--

UNITED STATES PATENT AND TRADEMARK OFFICE

CERTIFICATE OF CORRECTION

PATENT NO. : 7,146,125 B2
APPLICATION NO. : 10/678287
DATED : December 5, 2006
INVENTOR(S) : Eric C. Stelter et al.

It is certified that error appears in the above-identified patent and that said Letters Patent is hereby corrected as shown below:

Column 8, Line 48, delete “40” and insert --35--

Column 8, Line 65, delete “photoreceptor” and insert --photoconductor--

Column 9, Line 3, delete “photoreceptor” and insert --photoconductor--

Column 9, Line 8, delete “sheet,” and insert --sheets,--

Column 9, Lines 8-9, delete “photoreceptor” and insert --photoconductor--

Column 9, Line 16, delete “photoreceptor” and insert --photoconductor--

Column 10, Line 9, delete “photoreceptor” and insert --photoconductor--

Column 10, Line 14, delete “photoreceptor” and insert --photoconductor--

Signed and Sealed this

Twenty-sixth Day of May, 2009

JOHN DOLL
*Acting Director of the United States Patent and Trademark Office*